United States Patent [19]

Frisbee

[11] 4,074,769

[45] Feb. 21, 1978

[54] BULLDOZER BLADE CONTROL

[75] Inventor: Claude M. Frisbee, Bettendorf, Iowa

[73] Assignee: J. I. Case Company, Racine, Wis.

[21] Appl. No.: 680,817

[22] Filed: Apr. 28, 1976

[51] Int. Cl.[2] ..... E02F 3/76

[52] U.S. Cl. ..... 172/804

[58] Field of Search ..... 172/801, 802, 803, 804, 172/805, 806, 807, 808, 809

[56] References Cited

U.S. PATENT DOCUMENTS

| | | | |
|---|---|---|---|
| 2,678,508 | 5/1954 | Reuter | 172/807 |
| 3,157,099 | 11/1964 | Ulrich | 172/277 X |
| 3,539,021 | 11/1970 | Campen | 172/803 |
| 3,645,340 | 2/1972 | Frisbee | 172/804 |
| 3,920,081 | 11/1975 | Terai | 172/801 |

*Primary Examiner*—Richard J. Johnson

*Attorney, Agent, or Firm*—Cullen, Settle, Sloman & Cantor

[57] ABSTRACT

A bulldozer having a transverse blade and angling cylinders on opposed sides each cylinder having a rod connected to the bulldozer and a forwardly extensible cylinder operably connected to the sides of the blade for hydraulically angling the blade about a vertical axis. The hydraulic control includes a plurality of lines extending in an arch from adjacent the bottom of the front of the bulldozer to the back of the blade. The blade includes a channel-shaped shroud or guard extending from one side of the blade to the other which receives the lines. The lines then extend in opposite directions to the angle cylinders, eliminating the present requirement for hollow rod-trunnion mounted angle cylinders and permitting the use of solid rod piston cylinders.

8 Claims, 4 Drawing Figures

FIG. 1
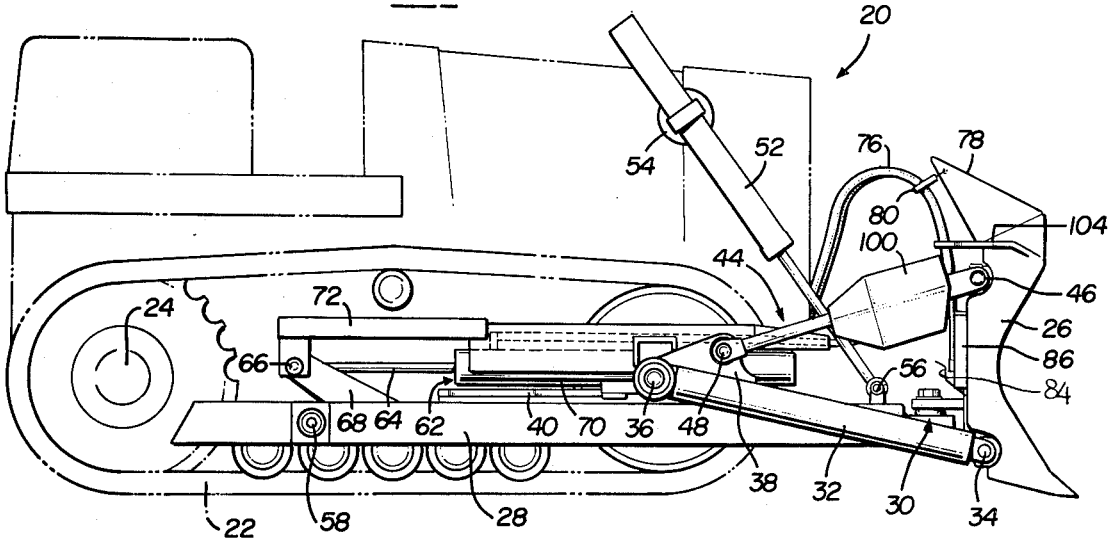
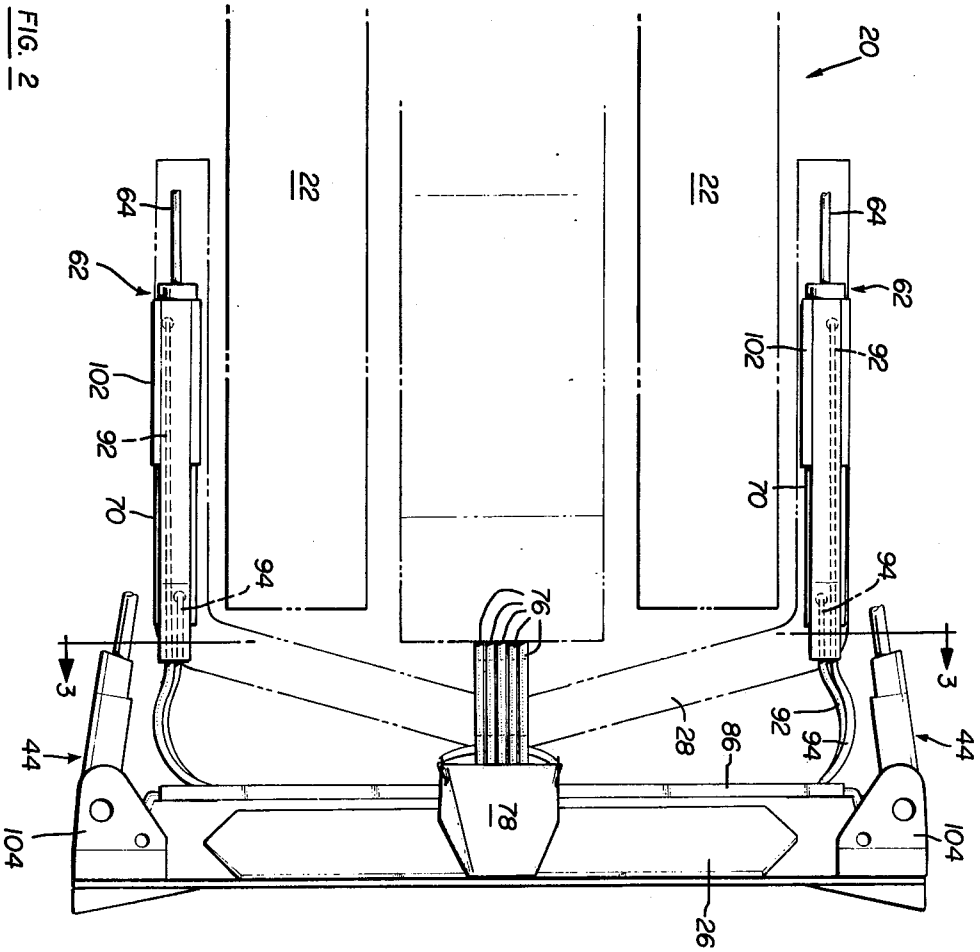
FIG. 2

BULLDOZER BLADE CONTROL

FIELD OF THE INVENTION

The present invention relates to bulldozers or the like having transversely extending blades and more particularly to hydraulic means for adjusting the position of the blade, particularly about a vertical axis, commonly referred to as angling.

A modern bulldozer blade may be hydraulically angled, tilted, pitched, raised and lowered to adjust the blade in any desired position. The blade is preferably supported on a U or C-shaped frame which is pivotally connected adjacent its ends to the sides of the bulldozer as shown in U.S. Pat. No. 2,943,407, assigned to the assignee of the instant application. The blade is supported adjacent its midportion to the center of the frame and the opposed sides are connected to hydraulic cylinders for angling, pitching or tilting of the blade. Where the control includes all three functions, the blade is supported on a ball joint such as shown in my U.S. Pat. NO. 3,645,340.

The blade is angled by piston-cylinders along the sides of the bulldozer connected at one end to the frame and operably connected at the opposed end to the sides of the bulldozer blade. One angle cylinder is extended while the opposed cylinder is retracted to adjust the blade about a vertical axis.

At present, there are two types of angling cylinders, including the solid rod end mounted cylinders shown in the above referenced U.S. Pat. No. 2,943,407 and hollow rod-trunnion mounted cylinders as shown in my above referenced patent. In the solid rod angle cylinders, the hydraulic cylinders are pivotally connected to the bulldozer and the rods extend forwardly to angle the bulldozer blade. The hydraulic lines extend out of the side of the bulldozer and are connected to the hydraulic cylinders. In the hollow rod-trunnion mounted angle cylinders, the rod end of each angle cylinder is pivotally connected to the bulldozer and the cylinder portion is extensible forwardly to angle the blade. The hydraulic control is then connected to the hollow piston rods to actuate the piston-cylinders. The hollow rod-trunnion mounted angle cylinders are presently preferred because of the simplicity of the hydraulic control and for the reasons set forth in my above referenced patent. The disadvantages of the hollow rodtrunnion mounted cylinders are cost and maintenance. The relatively long hollow piston rod is substantially more expensive than a more conventional solid piston rod. The disadvantages of the present solid rod, end mounted angle cylinders are (1) a limited degree of angle or angle stroke, and (2) a low column strength at maximum angle, i.e. full extension of one piston rod.

The improved bulldozer blade control of the present invention permits the utilization of a solid rod piston-cylinder without the disadvantages of the present rod end mounted cylinders by extending the hydraulic control lines from the front of the bulldozer to the angle cylinders. The flexible lines are protected by guards extending across the bulldozer blade from side to side as more fully described hereinbelow.

SUMMARY OF THE INVENTION

The bulldozer blade control of the present invention may be utilized in a conventional bulldozer having a side mounted frame such as the U-shaped frame disclosed in the above referenced patents, wherein the blade is mounted on the frame for angling, tilting, pitching, raising and lowering. The angling control of the present invention includes a piston-cylinder on opposed sides of the bulldozer, each piston-cylinder having a rearwardly extending piston rod operably connected to the dozer and a forwardly extensible cylinder operably connected to the sides of the dozer blade. The angle cylinder arrangement is therefore similar to the hollow rod-trunnion mounted cylinders disclosed in my above referenced United States Patent, providing the advantages of this arrangement. The control means however eliminates the requirement of hollow piston rods, thereby eliminating the primary disadvantages.

The hydraulic control of the present invention includes flexible hydraulic lines extending from the front of the dozer to the back of the scrapper blade, then in opposite directions along the back of the blade to the adjacent side edges of the blade. Finally, the hydraulic lines extend rearwardly, preferably along the side frames to the angle control cylinders. The bulldozer blade includes a channel-shaped shroud or guard extending across the blades from side to side. The hydraulic lines are received within the shroud and extend in opposite directions. In the disclosed embodiment, the shroud includes connections which distributes the hydraulic fluid to extend one angle cylinder forwardly while simultaneously retracting the opposed cylinders.

As stated, the preferred embodiment the bulldozer blade may be angled, tilted, pitched, raised and lowered. Thus, the hydraulic control lines must permit free movement of the blade and be protected against accidental damage. In the disclosed embodiment, the hydraulic lines extend from the front of the bulldozer, adjacent the bottom, in an arch to the top of the blade which includes a guide receiving the hydraulic lines. The tilt-pitched lines extend within the shroud or guard to the tilt-pitch cylinders adajcent the upper side edges of the blade. The blade may then be angled, tilted, pitched, raised or lowered without interferring with the hydraulic control. Further, the hydraulic control of the present invention eliminates the requirement for hollow rod piston-cylinders while retaining the advantages of the extensible cylinder angle control.

Other advantages and meritorous features of the bulldozer blade control of the present invention will be more fully understood from the following description of the preferred embodiments, the appended claims and the drawings, a brief description which follows.

BRIEF DESCRIPTION OF THE DRAWINGS

FIG. 1 is a side elevation of a conventional bulldozer having the improved blade control of this invention;

FIG. 2 is a partial top view of the bulldozer shown in FIG. 1;

DESCRIPTION OF THE PREFERRED EMBODIMENTS

Figure 3:
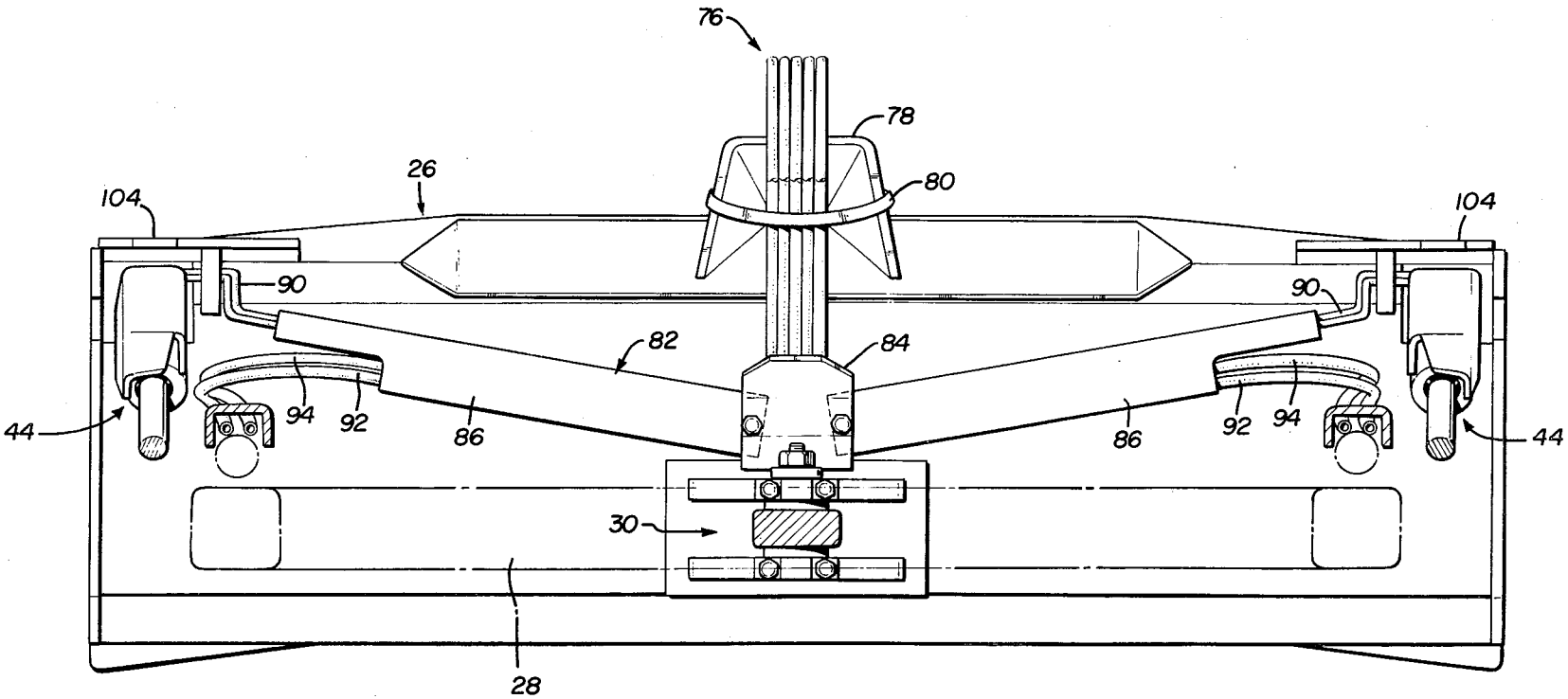
FIG. 3 is an end view of the bulldozer blade shown in FIG. 2, in the direction of view arrows 3—3; and, FIG. 4 is a top perspective view of a tilt-pitch cylinder with the related control lines.

A crawler tractor or bulldozer 20 having one embodiment of the bulldozer blade control of the present invention is shown in FIGS. 1 and 2. It will be understood however that the blade control of the present invention may be utilized in other implements having the prior art problems described hereinabove. For example, the blade control of the present invention may be utilized in a wheeled vehicle or tractor. The following description will however be limited to a bulldozer of the type shown for simplicity of illustration and because the blade control of the present invention is particularly suitable for a bulldozer of the type shown.

The disclosed bulldozer includes continuous tracks 22 on opposed sides of the bulldozer which are supported on transverse axles 24. The bulldozer includes a conventional transverse scrapper blade 26 which is supported on a C or U-shaped frame assembly 28. The midportion of the blade is preferably supported on the frame by a ball joint assembly 30 as more fully described in my above referenced United States Patent.

The lower edge of the blade is supported by struts 32 which are connected to the lower side corners of the blade by universal joints 34. The rearward ends of struts 32 are pivotally connected at 36 to slides 38. The slides in turn, are slidably secured to the frame assembly on slide tracks 40. The upper corners of the blade are connected to slides 38 by tilt-pitch cylinders 44. The tilt-pitch cylinders are connected to the upper corners of the blade by universal joints 46 and the rearward ends of cylinders 44 are connected to slide brackets 38 by pivotally connections 48.

Thus, in the disclosed embodiment of the bulldozer blade control, the blade 26 may be pitched about the horizontal axis of the ball joint 30 by simultaneously extending the opposed tilt-pitch cylinders 44. The blade may be tilted about the longitudinal axis of the bulldozer by extending one tilt-pitch cylinder 44 and retracting the opposed piston-cylinder. The blade in the disclosed embodiment may also be raised and lowered by lift piston-cylinders 52. The cylinders 52 are pivotally secured to the sides of the bulldozer by trunnion mountings 54. The piston rods of the lilt cylinders are connected to the bulldozer frame by trunnion connections 56. The opposed ends of the C or U-shaped frame are pivotally connected to the sides of the bulldozer by pivotal connections 58. The blade may thus be raised by simultaneously retracting the lift cylinders 52, wherein the frame and the supported blade are raised by pivoting the frame and the supported blade 26 about frame axis 58.

The blade of the disclosed embodiment of the bulldozer may thus be tilted or pitched by operation of piston-cylinders 44, raised or lowered by operation of piston-cylinders 52 and angled as described below about the vertical axis of the center ball joint 30. It will be understood however that the control of the present invention may also be used in an angle-tilt bulldozer such as disclosed in the above referenced U.S. Pat. No. 2,943,407 or a more simple angle bulldozer. Details of the control mechanism and structure necessary for pitching, tilting, raising and lowering the bulldozer blade may be found in more detail in my above referenced U.S. Pat. No. 3,645,340.

As described, the angle cylinder arrangement may be generally similar to the angle control disclosed in my above referenced U.S. Pat. No. 3,645,340. The angle cylinders 62 each include a piston rod 64 pivotally connected at 66 to a bracket 68 connected to the frame 28. The cylinder portion 70 is pivotally connected to slide 38 and therefore operably connected to the sides of the bulldozer blade 26 to angle the blade about the vertical axis of ball joint 30. A cover guard 72 is pivotally connected at 66 to bracket 68 which protects the angle cylinders from accidental damage. Angling is accomplished by extending one cylinder 70 and retracting the opposed cylinder, thereby extending one slide 38 and retracting the opposed slide to move the blade about the vertical axis of ball joint 30.

In the angle cylinder arrangement disclosed in my above referenced United States Patent, the piston rods are hollow and the hydraulic lines extend out of the bulldozer at the rear of the push trunnion and are connected to the hollow piston rods. The piston rods of the angle control must be able to withstand the force of plowing at any angled position, requiring great axial and torsion strength. The hollow piston rods are therefore very expensive. The improved blade control of this invention permits the use of solid piston rods, which substantially reduces the cost of the angle cylinders while retaining the advantages of forwardly extensible cylinders described above. Further, the rear hydraulic control lines of the hollow rod-trunnion mounted cylinders were subject to damage, which has been eliminated by the forward hydraulic control lines utilized in the present invention.

Figure 4:
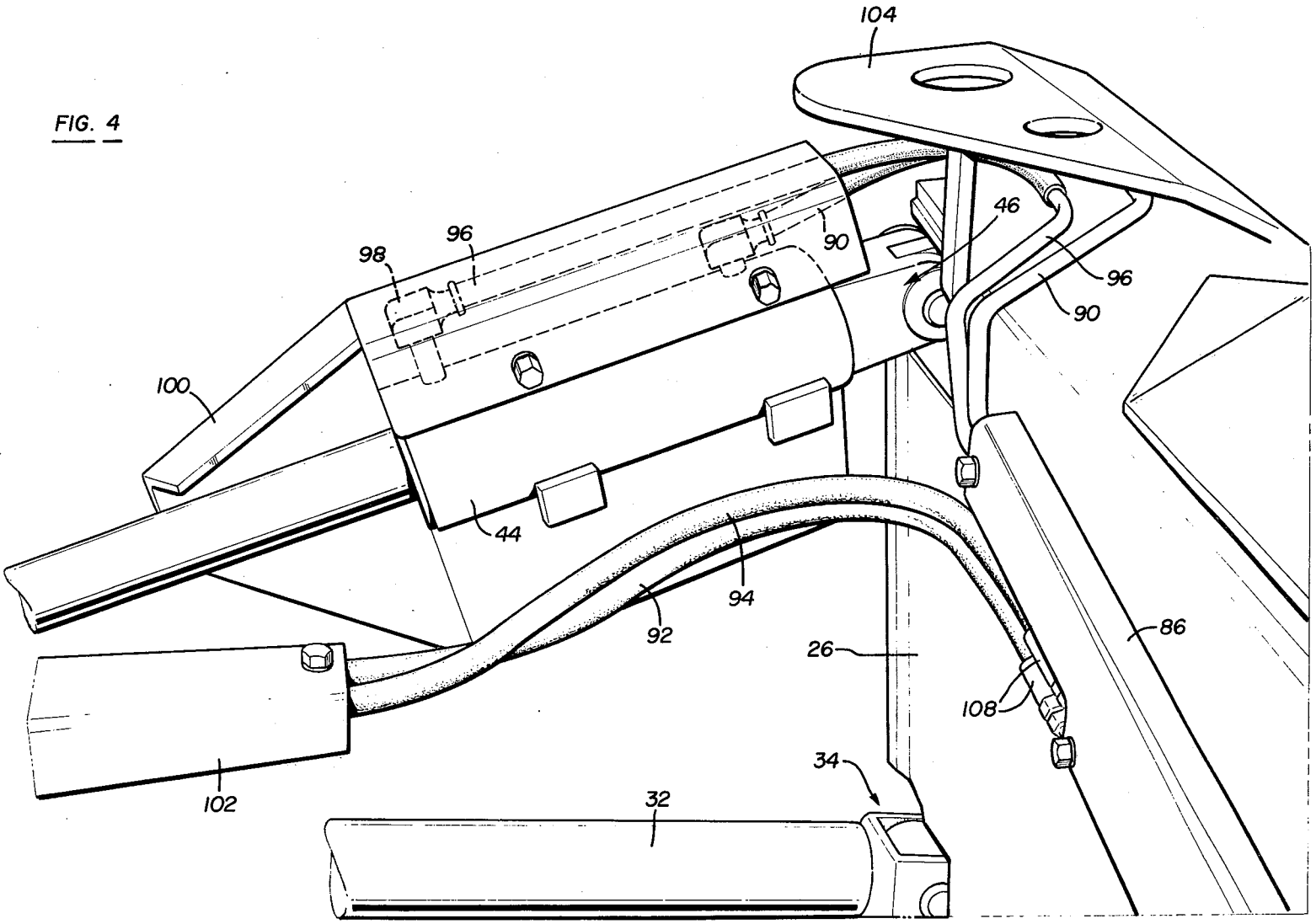

As shown in FIG. 1, the hydraulic control lines 76 extend in an arch from the lower forward end of the bulldozer to the back of the bulldozer blade 26. A cowl or guide 78 is provided on the top of the bulldozer blade having a guide strap 80 receiving the control lines. The control lines then extend downwardly along the back of the bulldozer blade to a guard or shroud 82 which extends longitudinally along the back of the blade from side to side. The shroud 82 includes a center cover or access plate 84 and a pair of oppositely extending channel-shaped guard elements 86. As shown, there are five hydraulic control lines 76 for an angle, tilt, pitch bulldozer of the type shown. Two of the lines 90 extend directly from the bulldozer to the forward or head end of the tilt-pitch cylinders 44. The remaining three lines are divided by T-couplings behind access plate 84 as follows. Lines 92 are connected to the rod ends of angle cylinders 70, lines 94 are connected to the head ends of angle cylinders 70, and lines 96 are connected to the rod ends of tilt-pitch cylinders 44 as shown in FIG. 4. The plumbing, including valves, pump, etc. may be generally similar to the angle, tilt-pitch control disclosed in my above referenced U.S. Pat. No. 3,645,340.

The lines 90 to 96 may be connected to cylinders 44 and 70 by conventional connectors, such as shown at 98 in FIG. 4. Guards 100 are attached to tilt-pitch cylinders 44 by welding or other suitable means, as shown in FIGS 1 and 4, to protect the piston-cylinders and the control lines 90 and 96. Channel-guards 102 protect angle cylinders 70 and control lines 92 and 94 as shown in FIGS. 2 and 4. Guard plates 104 are connected to the top outer edges of blade 26 to protect lines 90 and 96.

Lines 76 are flexible hydraulic lines and extend in an arch from the bulldozer to the back of the bulldozer blade to permit raising and lowering of the bulldozer blade as described above. Flexible hydraulic lines are available commercially from various sources and are generally formed from reinforced polyurethane, polytetrofluoroethylene or synthetic rubbers. Lines 92 and 94 include a slack portion between the back of the bulldozer blade and channel guard 102 as shown in FIGS. 2 and 4 to permit the blade to be angled, tilted and pitched. The lines, where flexibility is not required may be formed of metal pipe. For example, couplings are provided as shown in FIG. 4 between the flexible hydraulic lines and the metal pipes. The angle cylinder 70 may therefore be extended or retracted while coupled by flexible lines 92 and 94 to the hydraulic control, with the slack portion being protected between the blade 26 and the guard or shield 100.

The hydraulic control of this invention thus eliminates the requirement for hollow rod-trunnion mounted angle cylinders, while retaining the advantages of this arrangement and simplifying the hydraulic circutry. The bulldozer may be raised and lowered by lift cylinders 52 without interfering with the control lines 76 and the blade may be angled, titled, and pitched without interfering with the control lines to the cylinders 90 to 96. The bulldozer blade control of the present invention therefore provides an alternative to the angle controls of the prior art, while retaining the advantages of each. The angle control of this invention eliminates the requirement of machined hollow rod pistons, while permitting full angle stroke and increasing the column strength of the angle cylinders. Further, the front hydraulic lines utilized in the present invention simplifies the hydraulic circuit for angling, pitching and tilting, while limiting the likelihood of damage to the hydraulic control lines.

Having thus described the improved bulldozer blade control of this invention, and its operation in detail, what is claimed is:

1. A vehicle having a U-shaped frame extending around the forward end of said vehicle, a transverse blade pivotally mounted adjacent its center on the forward end of said frame for angling movement about a vertical axis, a piston cylinder on opposed sides of said vehicle each having a rearwardly extending piston rod pivotally connected to said frame and a forwardly extensible cylinder spaced from said blade and each cylinder operably connected to said blade on opposed sides by a strut means, and a hydraulic control means having flexible lines extending from the lower front of said vehicle to the back of said blade adjacent the center of said blade in a downwardly opening flexible arch, said lines received in a channel-shaped shroud extending across the rear of said blade, said lines then extending in opposite directions along the back of said blade within said shroud and then back to said cylinders of said hydraulic piston-cylinders, said control means extending one cylinder while retracting the opposed cylinder to angle said blade about a vertical axis.

2. The vehicle defined in claim 1 having a channel-shaped shroud extending across the back of said blade, said hydraulic lines extending into the midportion of said shroud to couplings which divide the lines in opposite directions within said shroud to the sides of said blade.

3. The vehicle defined in claim 2 wherein each said strut means includes tilt piston-cylinders on opposed sides of said vehicle, each operably connected between the upper side of said blade and said angle cylinders, characterized in that said flexible hydraulic lines extend in an arch from the lower center portion of said vehicle to the upper edge of said blade, then into said shroud and connected to said cylinders.

4. A vehicle having a generally U-shaped frame extending around the forward end of said vehicle, a blade mounted on said frame for angling movement about a vertical axis and tilting movement about a horizontal axis perpendicular to said blade, an angling cylinder on opposed sides of said vehicle each having a rearwardly extending piston rod pivotally connected to said frame and a forwardly extensible cylinder portion, a tilt piston cylinder on opposed sides of said vehicle operably connected between one of said angle cylinder portions and said blade sides, and a hydraulic control means having a plurality of flexible hydraulic lines extending from the forward end of said vehicle to the midportion of the back of said blade, a channel-shaped shroud extending across the rear of said blade from side to side, said lines extending into the midportion of said shroud and then in opposite directions to the sides of said blade, then rearwardly to the cylinder portions of said angle and tilt cylinders, and said lines having a flexible slack portion between said blade and said cylinders permitting free angling and tilting motion of said blade.

5. The vehicle defined in claim 4, wherein said U-shaped frame is pivotally connected to said vehicle on opposed sides thereof, lift cylinders pivotally connected to said vehicle and said frame to raise and lower the forward end of said frame and said blade about said pivotal connections, and said flexible lines defining an arch from the lower portion of said vehicle to the upper portion of the back of said blade, then downwardly to said shroud and a guide adjacent the upper edge of said blade receiving said lines.

6. A bulldozer having a U-shaped frame pivotally connected adjacent its ends on the sides of said bulldozer and extending around the forward end of said bulldozer, a transverse blade supported on said frame for universal movement, angle cylinders on opposed sides of said blade each having a rearwardly extending piston rod operable connected to said bulldozer and a forwardly extensible piston cylinder operably connected to said blade, tilt cylinders on opposed sides of said vehicle each operably connected to said vehicle and the upper sides of said blade to tilt said blade about the longitudinal axis of said bulldozer, a lift cylinder operably connected to said bulldozer and said frame to lift the forward end of said frame and said blade about the pivotal connections of said frame, and a hydraulic control means for said cylinders having a plurality of flexible hydraulic lines extending in an arch from the lower front of said bulldozer to the upper center portion of the rear of said blade, said blade having a guide adjacent its upper edge receiving said lines and a channel-shaped guard extending across said blade from side to side, said lines extending in opposite directions within said guard to adjacent the side edges of said blade and then said lines extending rearwardly to said angle and tilt cylinders and said lines having a flexible slack portion between said blade and said cylinders permitting free angling and tilting movement of said blade.

7. The bulldozer defined in claim 6, including a channel-shaped shield extending along the side portions of said frame receiving and protecting the hydraulic lines to said angle cylinders.

8. A bulldozer blade control for angling, pitching and tilting a bulldozer blade supported transversely at the forward end of said bulldozer, said control including an angle piston-cylinder on opposed sides of the bulldozer, each angle piston-cylinder having a rod connected to the bulldozer and an extensible cylinder operable connected to one side of said bulldozer blade and a tilt-pitch piston-cylinder on opposed sides of said bulldozer, each tilt-pitch piston-cylinder operable connected between said bulldozer and one side of said bulldozer blade and a hydraulic control means adapted to extend one angle cylinder while retracting the opposed angle cylinder to angle said bulldozer blade, simultaneously extending or retracting said tilt-pitch piston-cylinders to pitch said bulldozer blade or extending one tilt-pitch cylinder while retracting the opposed tilt-pitch cylinder to tilt said bulldozer blade, the improvement comprisingflexible hydraulic control lines extending in an arch from the front of said bulldozer to the rear of said bulldozer blade, two of said hydraulic control lines extending in opposite directions along the back of said bulldozer blade to the head end of said tilt-pitch cylinders, the remaining three lines divided and extending in opposite directions to connect to the head and rod ends of said angle cylinders and the rod end of said pitch-tilt cylinders and a guard on the rear of said bulldozer blade extending to adjacent the side edges of said blade and enclosing the four hydraulic control lines extending in each direction to the angle and tilt-pitch piston-cylinders.

* * * * *